US005507239A

United States Patent [19]

Fujii et al.

[11] Patent Number: 5,507,239

[45] Date of Patent: Apr. 16, 1996

[54] NEEDLE BAR STOP DEVICE OF SEWING MACHINE

[75] Inventors: Hisao Fujii; Katsuhiko Iwai, both of Osaka, Japan

[73] Assignee: Yamato Mishin Seizo Kabushiki Kaisha, Osaka, Japan

[21] Appl. No.: 359,478

[22] Filed: Dec. 20, 1994

[30] Foreign Application Priority Data

Dec. 20, 1993 [JP] Japan ..... 5-320504

[51] Int. Cl.[6] ..... D05B 55/16

[52] U.S. Cl. ..... 112/274; 112/221

[58] Field of Search ..... 112/271, 284, 112/220, 274

[56] References Cited

U.S. PATENT DOCUMENTS 3,779,187 12/1973 Adams ..... 112/221 X 4,259,916 4/1981 Marchesi ..... 112/221

4,444,136 4/1984 Slomma ..... 112/221

5,003,899 4/1991 Ogawa ..... 112/221

*Primary Examiner*—Ismael Izaguirre

*Attorney, Agent, or Firm*—Darby & Darby

[57] ABSTRACT

A needle bar stop device for a sewing machine in which a needle bar arm is separated into two parts, a first arm on a main shaft side, the rotation of which is controlled by a sub-shaft and a second arm on the needle bar side which is capable of rotating about the sub-shaft. An extended part is provided on either the first armor the second arm extending along the side surface of the other arm, and an insertion hole is formed in the extended part. An engaging hole is formed in the other arm so as to be capable of aligning with the insertion hole. A movable engaging member fitting in the insertion hole is part of a coupling mechanism that is selectively operated to cause the engaging member to engage with and disengage from the engaging hole.

7 Claims, 8 Drawing Sheets

NEEDLE BAR STOP DEVICE OF SEWING MACHINE

BACKGROUND OF THE INVENTION

1. Field of the invention

This invention relates to a needle bar stop device of a sewing machine which enables a needle bar of a sewing machine to stop temporarily, such as a needle bar stop device of the sewing machine applicable to a covering chain stitch sewing machine (flat seamer) which sews back shoulder seams of shirts and crotch over lapped seams of brief and shorts, 2. Description of Related Arts For the purpose of doing highly efficiently the back shoulder seams of shirts and the crotch over lapped seams of brief and shorts, a special covering chain stitch sewing machine has been put to practical use which is equipped with a narrow cylindrical bed and a knife mechanism, located in front of a needle location, on a presser foot for holding and pressing cloth on this bed. The crotch over lapped seams are made by this sewing machine by hems of crotch cloth forming the crotch part that are lapped over each other to be put through the bed, the lapped part being held and pressed between the presser foot and the bed and sent to the needle location while one or both hems are being cut automatically by means of the action of the knife mechanism.

The above-stated knife mechanism is equipped with a movable knife moving repeatedly in synchronism with the moving of a needle according to a transmission member branched in the middle of a transmission system transmitting action from a main shaft to a needle bar of a sewing machine, and a fixed knife sliding along this movable knife. The hems of cloth which are to be cut are led to the cutting part of the both knifers by a guide groove opening in front of the presser foot, and cut off. In consequence, the proper overlapped breadth corresponding to the seam breadth can be obtained steadily and fine regulation of the overlapped breadth by a worker can be dispensed with, which can achieve substantial improvement of work efficiency.

The hems of cloth are cut off in front of the needle location in the covering chain stitch sewing machine equipped with the above knife mechanism. Consequently it is necessary to start cutting off the hems of cloth from the very first seaming part set in front of the knife mechanism in order to make the overlapped breadth proper from the initial stage of seaming. In this case, however, a threadchain is formed in front of the first seaming part caused by the action of a needle while the first seaming part of cloth moves from the set position at the initial stage to the needle location. A problem arises as to the disposal of this threadchain after seaming is finished.

This problem can be solved by means of suspending only the seaming action produced by vertical motions of the needle without stopping the action of the knife mechanism until the first seaming part of cloth moves from the set position at the initial stage to the needle location, then starting vertical motions of the needle when the first seaming part of cloth reaches the needle location. This can be realized by adopting the stop device of a needle bar proposed in Japanese Patent Application Laid-Open No. 6-23184 (1994) by the applicant of this patent.

FIG. 1 is a perspective view showing the construction of a transmission system for a needle bar equipped with the above-stated stop device of a needle bar. FIG. 2A and 2B are views for explanation of the action of the needle bar stop device. The transmission system on the main shaft 3 side, as shown in FIG. 1, is equipped with a crank 30 installed in the middle of the main shaft 3 and a crank arm 31 pivotably-supported at the base end by this crank 30. The transmission system on a needle bar 10 side is equipped with a needle bar holder 12 holding the middle of the needle bar 10 and a link member 13 pivotably-supported at one end by the needle bar holder 12. A needle bar arm 4 supported in the middle position to be able to sway. A hollow sub-shaft 5, connects the link member 13 and the crank arm 31.

The needle bar arm 4 is composed of two separate parts, a first arm 41 on the main shaft 3 side and a second arm 42 on the needle bar 10 side. The first arm 41 is connected to a sub-shaft 5 with its rotation restrained and the second arm 42 is connected to the sub-shaft 5 rotatably through the penetration collar **42*b* on one end. An operation rod 6 is inserted in the hollow part of the sub-shaft 5 to be able to slide in the axial direction. An engaging hole 44 is formed, penetrating through the circumferential wall of the penetration collar 42*b* of the second arm 42 fixed on the outside of the sub-shaft 5. The needle bar stop structure is formed in the hollow part of the sub-shaft 5 corresponding to the position of the engaging hole 44**.

The operation rod 6, as shown in FIG. 2A, 2B has a large diametral part 60 whose exterior diameter is nearly equivalent to the internal diameter of the sub-shaft 5, and a small diametral part 61 of the proper length provided with a taper part 62 decreasing its diameter gently, on one end of the large diametral part 60. The tip of the small diametral part 61 is inserted toward the innermost of the sub-shaft 5. The sub-shaft 5 is equipped with the retention hole 50 penetrating the circumferential wall in the direction of its radius in the position where the sub-shaft 5 is adjusted to the engaging hole 44 by the fixation of the penetration collar **42*b*. The engaging spheres 51, 51 are inserted in the retention hole 50. The diameter of each engaging sphere 51 is slightly smaller than that of the retention hole 50 and larger than that of the said engaging hole 44. The engaging spheres 51, 51 are restrained from slipping out of the both sides of the retention hole 50 by the operation rod 6 fixed inside the sub-shaft 5 and the penetration collar 42*b* fixed on the outside of the sub-shaft 5**.

The operation rod 6 is so constructed such that it is inserted in and pulled out of the hollow part of the sub-shaft 5 by means of the action of the control means connected to the large diametral part 60 projecting to one side of the sub-shaft 5. As shown by the arrow in FIG. 2A, in the case where the inserting power is applied to the operation rod 6 to insert it into the sub-shaft 5, each of the engaging spheres 51, 51 is pressed in the outside direction of the radius by the inclination of the taper part 62 approaching the internal part of the retention hole 50 and is engaged in the engaging hole 44 formed in the penetration collar **42*b* of the second arm 42. Consequently, the sub-shaft 5 and the penetration collar 42*b* come to be connected together. On the other hand, as shown by the arrow in FIG. 2B, in the case where retreating power is applied to the operation rod 6 to pull it out of the sub-shaft 5, the small diametral part 61 is adjusted inside of the retention hole 50 and each of the engaging spheres 51, 51 is pressed inside by the component force in the direction of the radius applied to the contact part with the engaging hole 44 and removes the engagement with the engaging hole 44. Consequently, the sub-shaft 5 and the penetration collar 42*b*** come to be unconnected.

In the transmission system of the above construction, the first arm 41 sways in response to the rotation of the main shaft. 3 transmitted via the crank 30 and the crank arm 31.

The sub-shaft 5, fixed at the tip of the first arm 41, usually rotates repeatedly within the limit of the predetermined angle. This repeated rotation is used to drive the knife mechanism above mentioned. In contrast to this, the sub-shaft 5 and the second arm 42 are connected or unconnected cut off by inserting or pulling out the operation rod 6, and the swaying of the second arm 42 during the rotation of the main shaft 3 and the vertical motion of the needle bar 10 due to the swaying occur only in the case where the operation rod 6 is in the inserting state and does not occur in the pulling-out state.

Consequently, by means of inserting and pulling out the operation rod 6, only the vertical motion of the needle bar 10 for the seaming action can be suspended without stopping the operation of the knife mechanism generated accompanying the repeated rotation of the sub-shaft 5. Also, a thread-chain can be prevented from being formed in front of the first seaming part and extra work for the disposal of this thread-chain becomes unnecessary by means of keeping the operation rod 6 in the pulling-out state until the first seaming part of cloth moves from the set position in the initial stage to the needle location, so as to insert the operation rod 6 when the first seaming part of cloth reaches the needle location.

The needle bar stop device of the above construction is applicable not only to sewing machine with the knife mechanism above mentioned but also to sewing machines with other attachments requiring the repeated operation, synchronous with the moving of a needle and the suspension of the needle bar during this repeated operation. Thus the needle bar stop device produces the same effectiveness in both types of these sewing machines. However, there arises a problem that the connection of the sub-shaft 5 and the second arm 42 caused by the inserting of the operation rod 6, as shown in FIG. 2A, occurs by the engaging spheres 51, 51 being engaged at the interior circumpherencial edge of the engaging holes 44, 44. The repeated rotation of the sub-shaft 5 is transmitted via this engaging part, and during this transmission, striking scars appear on the surfaces of the engaging spheres 51, 51 due to the repeated pressing of the engaging spheres 51, 51 against the interior circumpherencial edge of the engaging holes 44, 44. The scars grow gradually and cause unsatisfactory actions in due course.

This problem can be alleviated by increasing the number of the engaging spheres 51. In this case, however, the number of retention holes 50 for retaining the engaging spheres 51 is increased, and it becomes difficult to guarantee the proper operation of the sub-shaft 5 in this hole-formed part and a new problem arises as to cause breaking loss of the sub-shaft 5. Therefore, in the conventional needle bar stop device, the upper limit of the rotatory speed of the main shaft 3 by the driving force of the sub-shaft 5 and the needle bar 10, has to be limited and the conventional needle bar stop device cannot cope with the increased speed of the main shaft 3 being necessary for high speed seaming.

SUMMARY OF THE INVENTION

This invention has been devised to solve the above problems and one of the objects is to provide a needle bar stop device which alleviates the occurrence of the unsatisfactory operations in due course by cutting off repeatedly the transmission to the needle bar. This arrangement can cope with the tendency to seam at high speed, by means of cutting off the transmission to the needle bar through the member engaging in the state of surface-contact.

In a needle bar stop device of a sewing machine of this invention, a needle bar arm between a main shaft and a needle bar is composed of two separate parts. There is a first arm on the main shaft side with its rotation restrained by the sub-shaft and a second arm on the needle bar side rotatable with respect to the sub-shaft. The first arm or the second arm is equipped with an extended part extending along the side surface of the second arm or the first arm. An engaging member is fixed to and movable from an insertion hole formed in the extended part and an engagement hole formed in the second arm or the first arm so as to be coupled to the insertion hole in the state of surface contact. The engaging member is detachable from engagement in the engagement hole by means of the operation rod for controlling the engaging member.

In the case where the engaging member is coupled to the engagement hole, the rotation of the main shaft is transmitted to the needle bar. In the case where the engaging member is detached from the engagement hole, the transmission of the rotation of the main shaft to the needle bar is suspended. Since the engaging member and the insertion hole or the engagement hole are coupled to each other, the above-stated needle bar stop device can cope with the tendency to seam at high speed.

The above and further objects and features of the invention will more fully be apparent from the following detailed description with accompanying drawings.

DESCRIPTION OF THE PREFERRED EMBODIMENT

Hereinafter, the present invention will be described according to the drawings showing the embodiment thereof.

Embodiment 1

Figure 1:
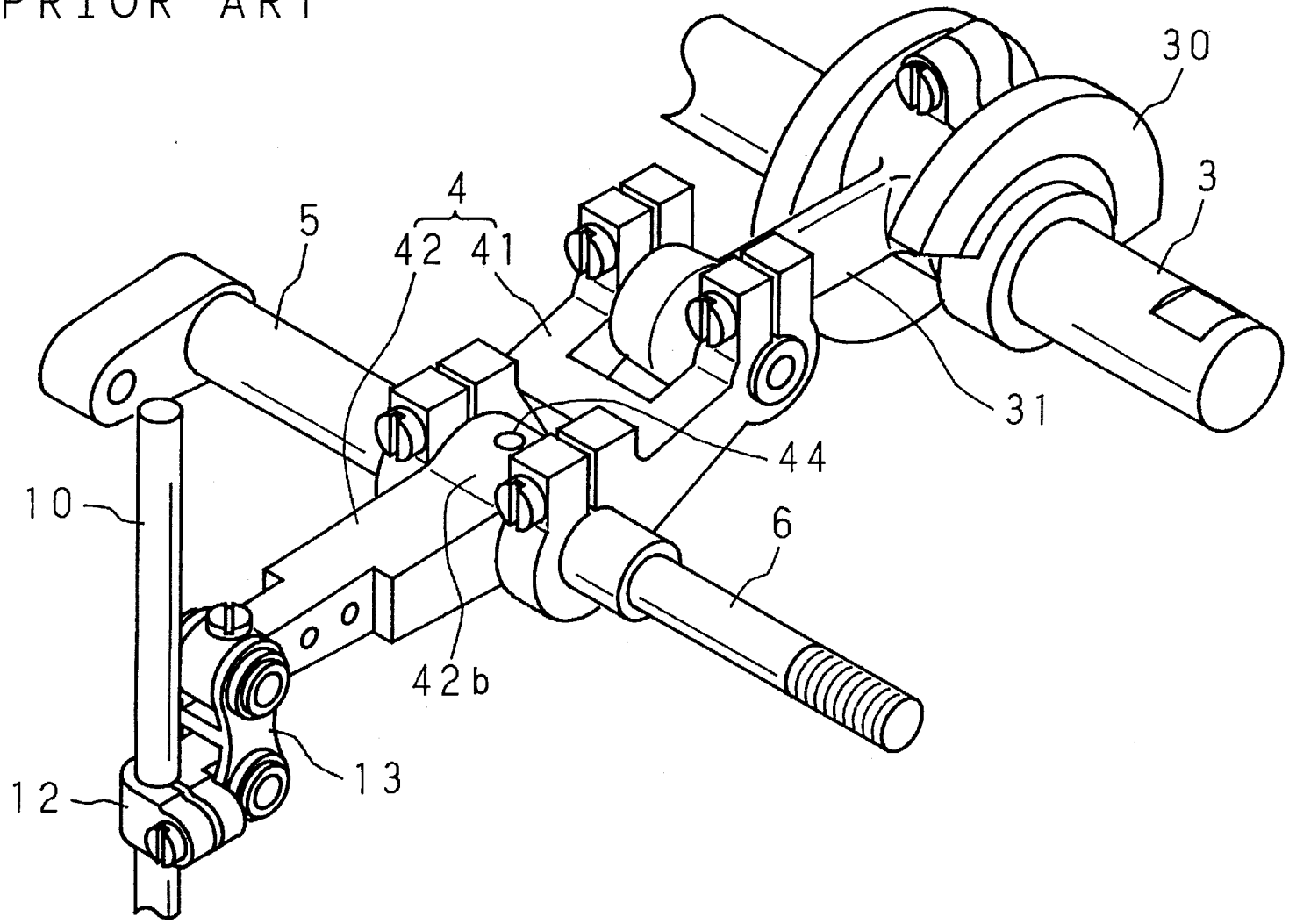
FIG. 1 PRIOR ART
FIG. 1 is a perspective view showing a construction of a prior are transmission system for a needle bar equipped with the conventional needle bar stop device.
Figure 2A:
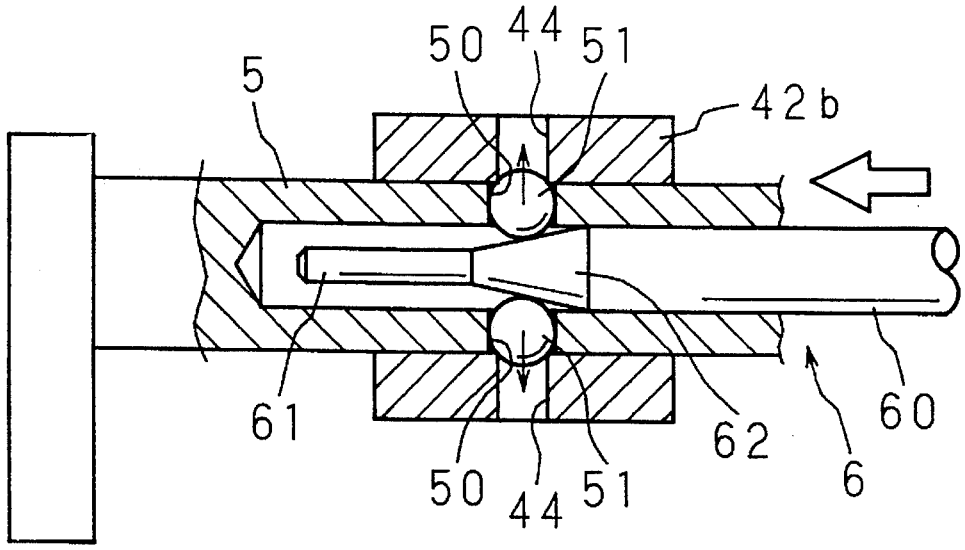
FIG. 2A PRIOR ART
FIG. 2A is a view for explanation of the operation of the conventional needle bar stop device.
Figure 2B:
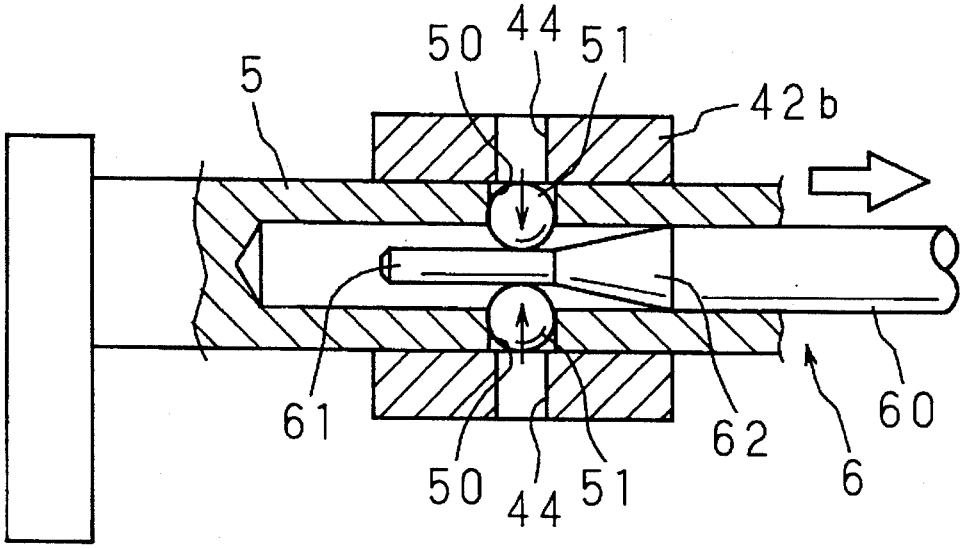
FIG. 2B PRIOR ART
FIG. 2B is a view for explanation of the operation of the conventional needle bar stop device.
Figure 3:
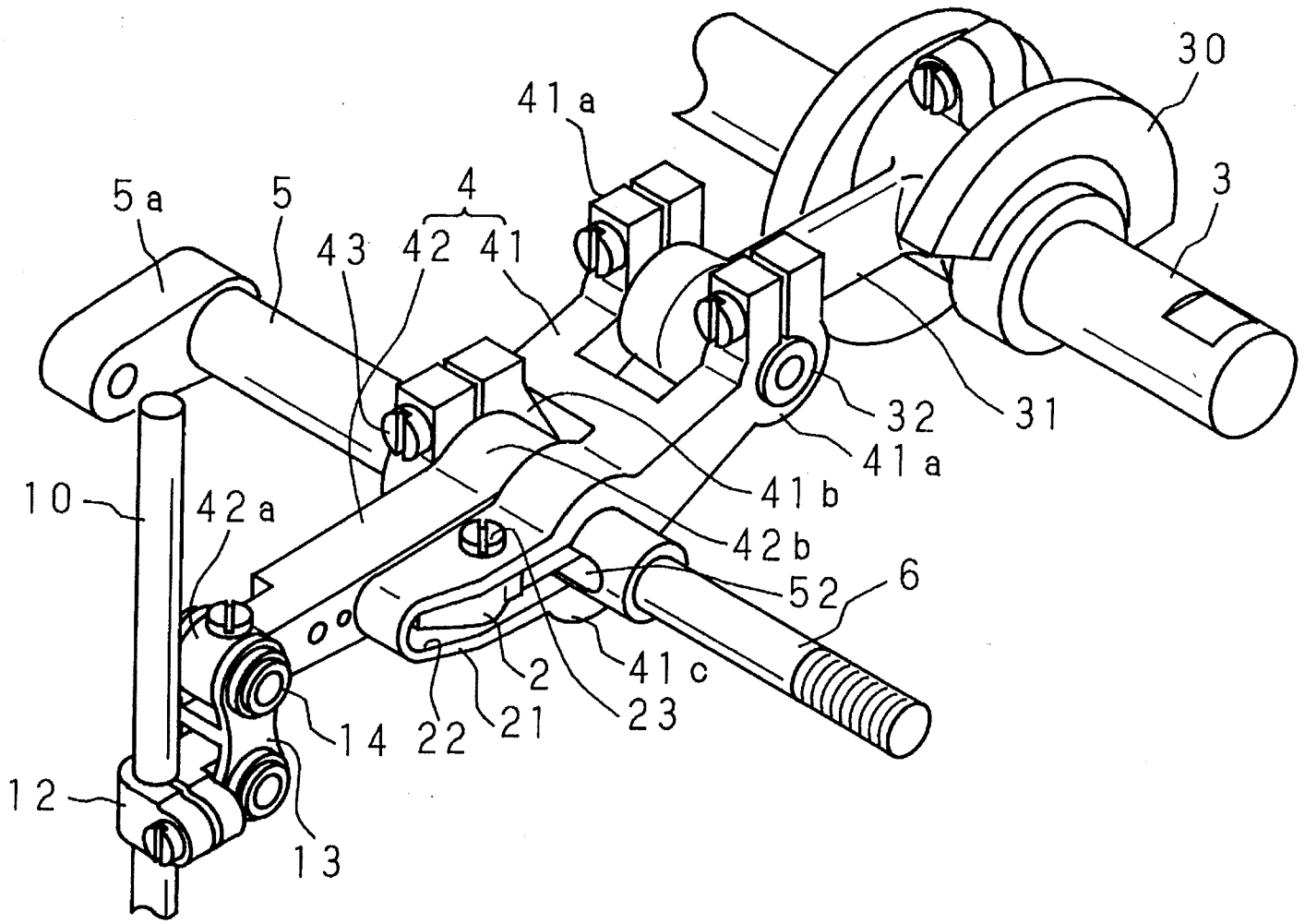
FIG. 3 is a perspective view showing the construction of a transmission system for needle bar equipped with the needle bar stop device of a first embodiment of the invention.
Figure 4:
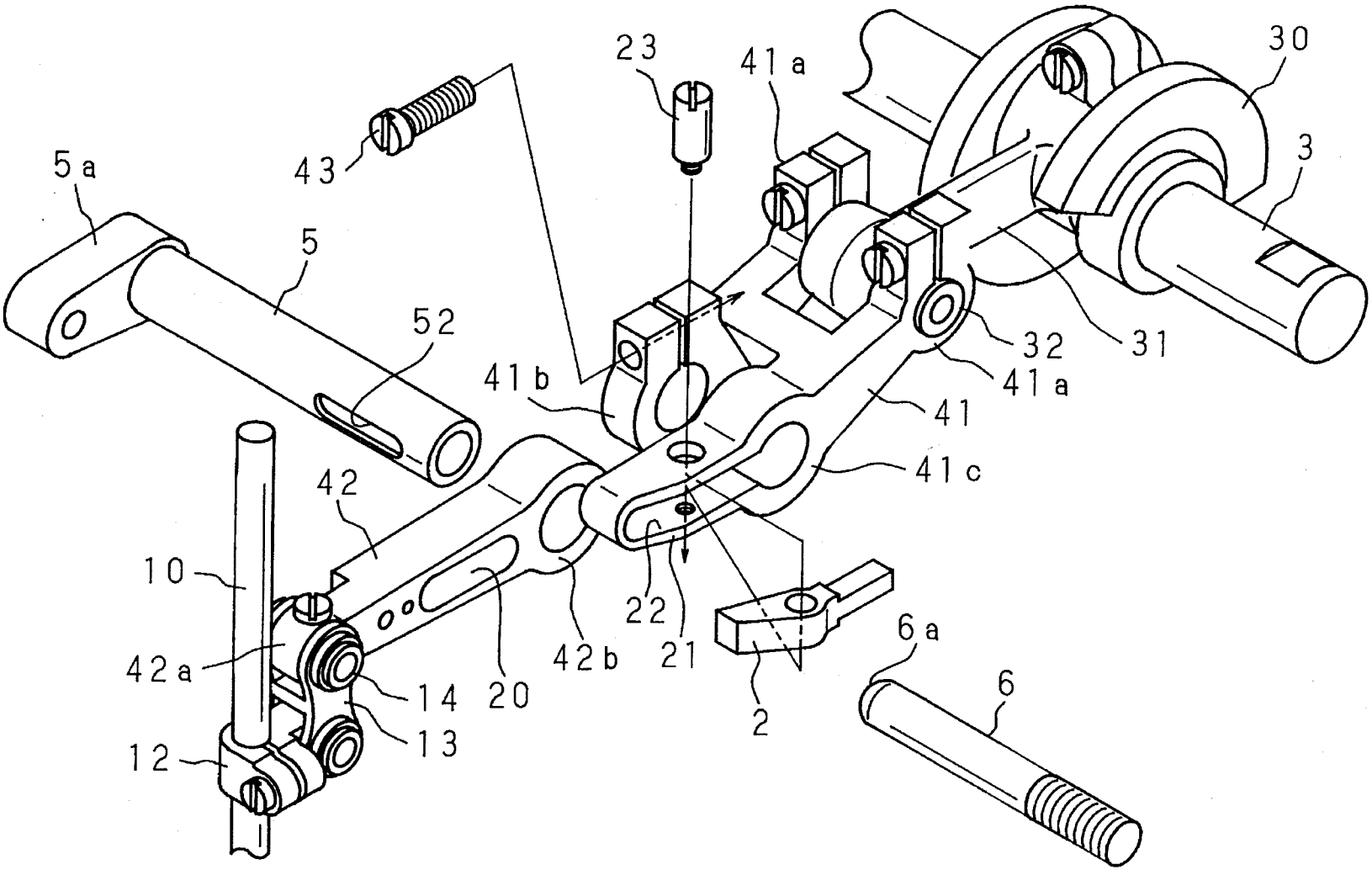
FIG. 4 is an analytical and perspective view showing the components of the needle bar stop device in the transmission system shown in FIG. 3.

FIG. 3 is a perspective view showing the construction of a transmission system for a needle bar equipped with the needle bar stop device of this invention (hereinafter referred to as a device of this invention). FIG. 4 is an analytical and perspective view of the components of the device of this invention in the transmission system shown in FIG. 3.

Figure 6:
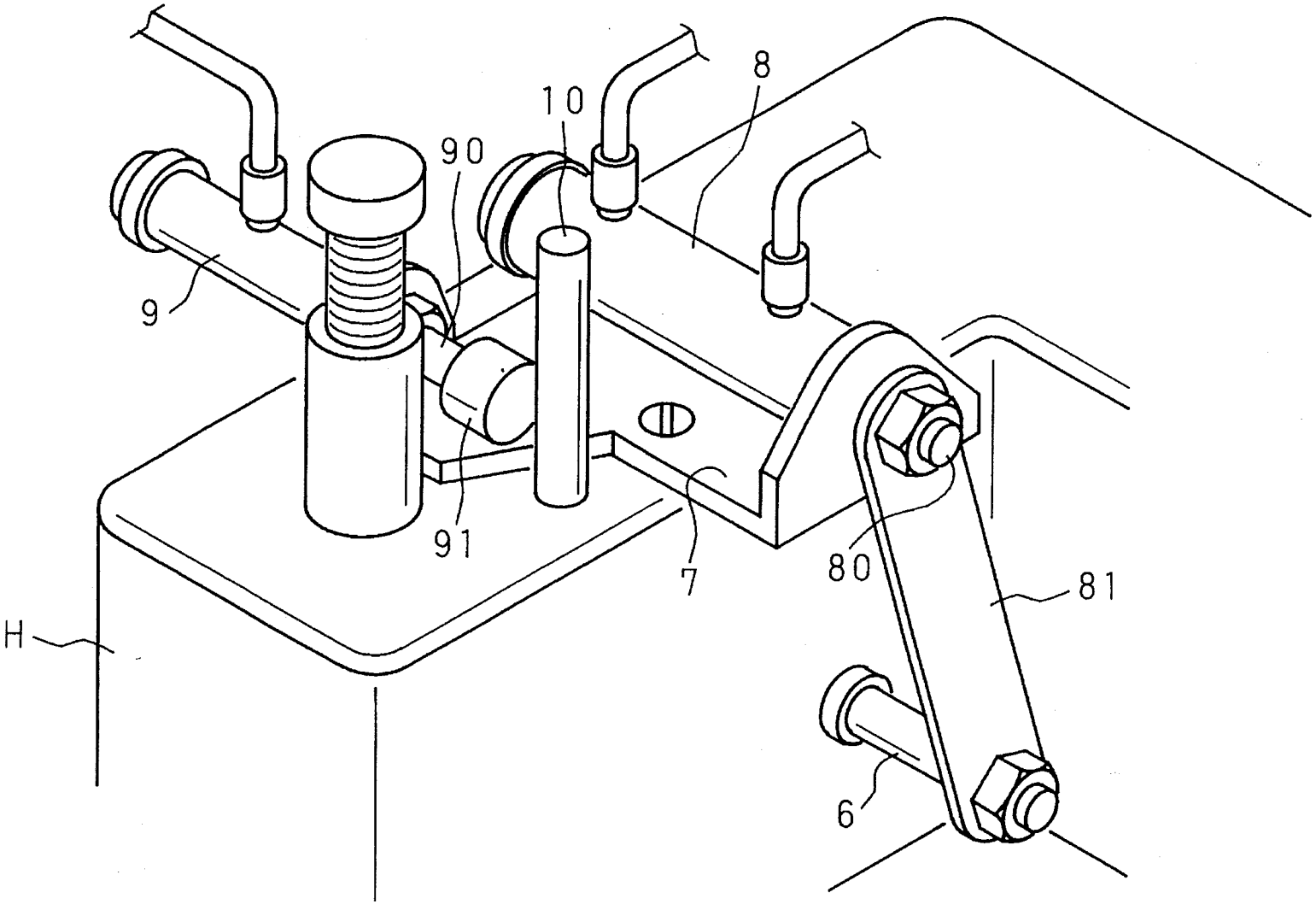
FIG. 6 is a perspective view showing an example of an operation means of the needle bar stop device of this invention.

Numeral 3 is a main shaft which is laid nearly horizontally on the cardinal part of the head part H of a sewing machine (see. FIG. 6). Numeral 10 is a needle bar which is supported so as to slide freely in the vertical direction, at the tip of the head part H. The lower end of the needle bar 10 is equipped with a plurality of needles. These needles move up and down in response to the vertical motion of the needle bar 10 generated by the transmission of the rotation of the main shaft 3, and perform seaming on the bed of the sewing machine equipped on the opposite side to the lower side of the head part H.

The transmission system is to convert the rotation of the main shaft 3 into vertical motion for the needle bar 10. On the part of the main shaft 3 side is a crank 30 fitted in the middle of the main shaft 3 and a crank arm 31 whose base end is pivotably-supported by the crank 30. On the needle bar 10 side is a needle bar holder 12 holding the middle part of the needle bar 10 and a link member 13 pivotably-supported at one end by the needle bar holder 12. Further, a needle bar arm 4, pivotal-supported in the middle thereof by the hollow sub-shaft 5 so as to be sway freely, is provided between the main shaft 3 and the needle bar 10. The tip of the crank arm 31 and the other end of the link member 12 are connected by the needle bar arm 4.

The needle bar arm 4, as shown in FIG. 4, is composed of two separate parts; the first arm 41 on the main shaft 3 side and the second arm 42 on the needle bar 10 side. The first arm 41 has a pair of throttle collars 41*a*, 41*a* on one end and a throttle collar 41*b* and a penetration collar 41*c* on the other end. The throttle collar 41*a*, 41*a* and 41*b* being capable of holding a shaft member with set screws. Further, at the penetration collar 41*c* is formed an extended part 21 projecting outward in the radial direction of the sub-shaft 5 along the one side surface of the second arm 42. On each of the ends of the second arm 42 is a throttle collar 42*a*, 42*b* respectively, capable of being inserted by a shaft member. The base end of the first arm 41 (the end of the main shaft 3 side) is connected to the tip of the crank arm 31 by the connection pin 32 which is tightened by a pair of throttle collars 41*a*, 41*a*. The tip of the second arm 42 (the end of the needle bar 10 side) is connected to the other end of the link member 13 by the hollow connection pin 14 which is inserted in the penetration collar 42*a* and fixed with a setscrew.

The throttle collar 42*b* is adjusted coaxially between the throttle collar 4lb and the penetration collar 41*c* and the sub-shaft 5 is inserted in this adjusted part. The first arm 41 and the sub-shaft 5 are connected with its rotation restrained by driving the set screw 43 to the throttle collar 41*b*. This connection leads the sub-shaft 5 to always rotate repeatedly within the limit of a predetermined angle in response to the rotation of the main shaft 3 transmitted via the crank arm 31 and the first arm 41. This rotation is extracted by the connection bracket 5*a* fixed on one end of the sub-shaft 5 and the link mechanism interlocked to this connection bracket 5*a*, and is used as a driving force of various attachments, such as the knife mechanism, requiring repeated operation synchronous with the moving of the needle.

The connection between the second arm 42 and the sub-shaft 5, enables relative rotation by inserting the sub-shaft 5 into the penetration collar 42*b*.

As shown in FIG. 4, at the nearly central area in the breadth direction of the extended part 21, there is formed an insertion hole 22, in the shape of a slot with a constant breadth, extending along the longitudinal direction of the extended part 21, including the fitting hole of the penetration collar 41*c* for the sub-shaft 5. The insertion hole 22 is attached with the engaging member 2. The engaging member 2 formed in the shape of prism is fitted in so as to contact both sides of the insertion hole 22 in the state of surface contact, and is supported so as to swing by a pivot pin 23 settled to cross, in the breadth direction, the middle portion of the insertion hole 22. There is formed a long engagement hole 20 extending along the longitudinal direction of the second arm 42, at the nearly central portion in the breadth direction of the side surface thereof. That is, the engaging hole 20 is formed having the nearly same breadth (the vertical length in the figure) as the insertion hole 22, in the position to align the tip of the insertion hole 22 for fitting and holding the engaging member 2. The engaging member 2 is capable of engaging its tip portion with the engaging hole 20 by the swing with a pivot pin 23 as a pivot. This engagement is produced while maintaining the state of surface contact to both sides in the breadth direction of the engaging hole 20.

In the middle of the sub-shaft 5 being a hollow shaft, there is formed a slot 52 penetrating through the circumferential wall in and out and having the predetermined length in the longitudinal direction excluding the penetrating position to the penetration collar 41*c*. The base end of the engaging member 2 projecting to the sub-shaft 5 side is made to approach through the slot 52 into the inside of the sub-shaft 5. Into the thread-chain of the sub-shaft 5 is inserted an operation rod 6 from the opening end of one thereof, slidably in the longitudinal direction. The swing of the engaging member 2 and its engagement and retreat to and from the engaging hole 20 along with this swing are produced by urging of the approach end of the engaging member 2 along with sliding of the operation rod 6 produced on the axis of the thread-chain, as follows.

Figure 5A:
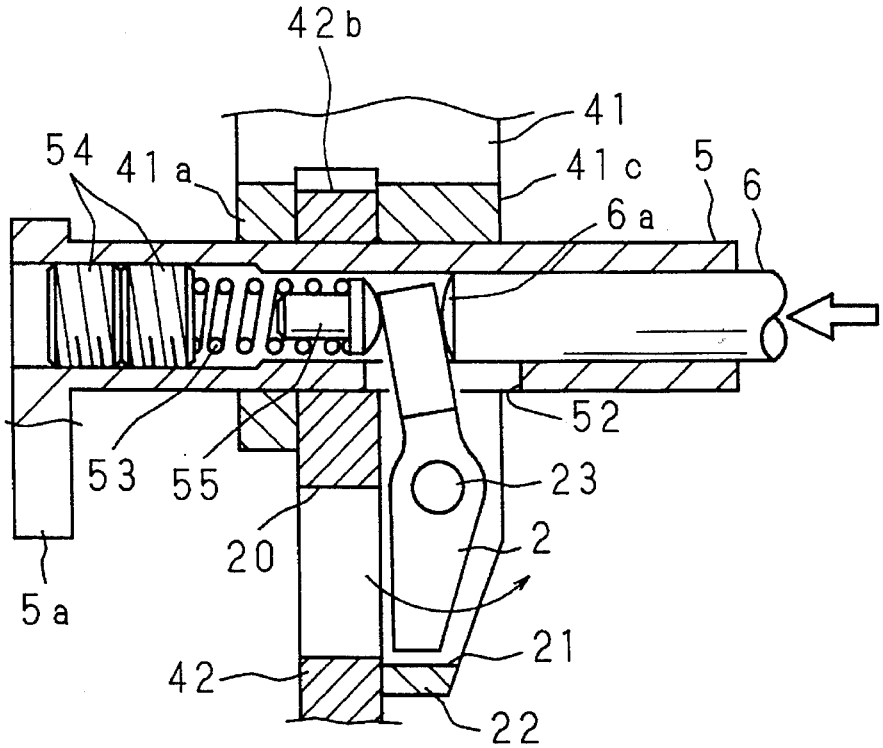
FIG. 5A is a view for explanation of the operation of the needle bar stop device in the first embodiment.
Figure 5B:
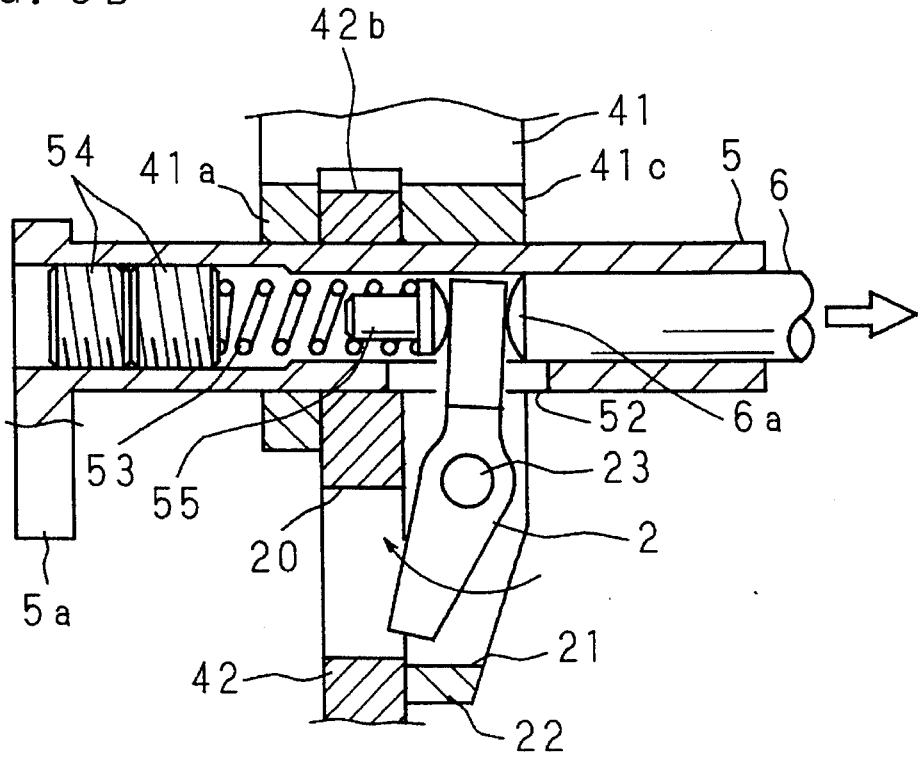
FIG. 5B is a view for explanation of the operation of the needle bar stop device in the first embodiment.

FIG. 5A, 5B are views for explanation of the operation of the device of the invention, showing the interior structure of the thread-chain of the sub-shaft 5. The sub-shaft 5 is also open on the opposite side to the inserting position of the operation rod 6, or on the connecting bracket 5*a* side, a push spring 53 is inserted from the opening side. This push spring 53 is supported at the base end by a pair of stopper screws 54, 54 screwed in the opening end of the thread-chain, and made to be resiliently contacted to the base end of the engaging member 2 through a push pin 55 Fixedly fit in the tip end of the push spring 53. Further, in the thread-chain of the sub-shaft 5, there is inserted the operation rod 6 from the other side, having an urging projection 6*a* of a hemisphere at its tip end projection 6*a* being abutted to the base end of the engaging member 2.

That is, the energization by the push spring 53 against the base end of the engaging member 2 approaching into the thread-chain of the sub-shaft 5 through the slot 52, is supported by the pushing of the operation rod 6. Consequently, as shown by a hollow arrow in FIG. 5A, when the inserting force of the operation rod 6 is in operation against the sub-shaft 5, the engaging member 2 is swung counter-clockwise with the pivot pin 23 as a pivot by urging of the base end opposing the energization of the engaging member 2, and the engagement between the tip end of the engaging member 2 the engaging hole 20 is released. Then, the sub-shaft 5 is rotated repeatedly along with the rotation of the main shaft 3 and the operation of the accessory units relying on the sub-shaft 5 for the driving power is continued. However, the rotation of the main shaft 3 is not transmitted to the needle bar 10 connected to the tip end of the second arm 42, so that the vertical motion of the needle bar 10 is stopped.

On the contrary, as shown by the arrow in FIG. 5B, when the retreating force from the sub-shaft 5 is in operation against the operation rod 6, the engaging member 2 is rotated clockwise by urging of the base end according to spring force of the push spring 53, and the tip end of the engaging member 2 is made to be engaged with the engaging hole 20. This engagement is produced on condition that the extended part 21 of the first arm 41 and the second arm 42 is in alignment in the circumferential direction. Due to this engagement, the first arm 41 and the second arm 42 is made in a unit through the extended part 21, the second arm 42 sways around the sub-shaft 5 in response to the rotation of the main shaft 3, and this swaying is transmitted through the link member 13 and needle bar holder 12 to the needle bar 10, and the needle bar 10 is to move up and down in response to the rotation of the main shaft 3.

And then, the integration of the first arm 41 and second arm 42 is made by the engaging member 2 fitting in the extended part 21 of the former and the latter in the state of surface contact, and the transmission of the rotation from the main shaft 3 to the needle bar 10 is produced through this portion of surface contact. According to this, it is possible to bear, with a comfortable margin, the swaying load of the needle bar arm 4 for the vertical motion of the needle bar 10, so that the device of the invention can cope with the increased speed of the main shaft 3, necessary for the high speed seaming without causing unsatisfactory operations of the needle bar 10.

FIG. 6 is a perspective view showing an example of operation means of the operation rod 6. The end part of the operation rod 6 projecting out of the sub-shaft 5 is made to project outward from the side surface of the head H which incorporates the transmission system as constituted above, and the operation of inserting and retreating of the operation rod 6 is performed at the projected end.

As shown in the drawing, on the base plate 7 secured on the upper surface of the head H, there are installed an air cylinder 8 for operating the insertion and retreat of the operation rod 6 and an air cylinder 9 for stopping the needle bar 10 in place. The air cylinder 8 is installed so that the direction of the insertion and retreat of the output rod 80 may agree with the longitudinal direction of the operation rod 6. The output rod 80 and operation rod 6 are connected with a joint plate 81 arranged between the tip ends of both rods. On the other hand, the air cylinder 9 is installed so that the tip end of the output rod 90 may face the projecting portion of the needle bar 10 above the upper surface of the head H. The tip end of the output rod 90 is fixed with a stopper 91 made of resilient material such as rubber.

Then, the operation rod 6 is applied with retreated force along with the approach of the air cylinder 8, and the engaging member 2 is made be engaged so as to be in the state of transmitting the rotation to the needle bar 10. Also, the inserting force is applied to the operation rod 6 along with the retreat of the air cylinder 8, the engagement of the engaging member 2 is released, and the transmission of the rotation to the needle bar 10 is interrupted, so that the vertical motion of the needle bar 10 can be stopped.

Further, in the case where the air cylinder 9 is put in the approach operation, the stopper 91 of the tip end of the output rod 90 is abutted to the needle bar 10, and the motion of the needle bar 10 is to be restrained. This restraint is necessary to hold the stop position of the needle bar 10. When the position of the needle bar 10 in the vertical motion is at the predetermined stop position (the upper dead point) previously set, the needle bar 10 stops the vertical motion along with the interruption of the transmission by causing the air cylinder 8 to retract and the air cylinder 9 approach simultaneously, and maintains the stop position at that time by pushing of the stopper 91. Also, the retraction of the air cylinder 9 for releasing the restraint is performed at the same time as the approach of the air cylinder 8 for re-opening the transmission.

The operation means for the operation rod 6 is not limited to the above-stated construction. For instance, it may be all right to adopt another construction in which an electric motor is used or the like. However, since the operation of the insertion and retreat of the operation rod 6 is in the linear motion in the longitudinal direction of the operation rod 6 and since this operation does not require a great power, the construction of this embodiment employing the air cylinder 8 is preferred.

Although the engaging member 2 of the rectangular post is used in the first embodiment the shape of the engaging member 2 is not limited to this. Any shape may be employed if it can obtain the state of surface contract to the insertion hole 22 on the first arm 41 side and the engaging hole 20 on the second arm 42 side, such as hexagonal post, octagonal post, and so on.

Embodiment 2

Figure 7A:
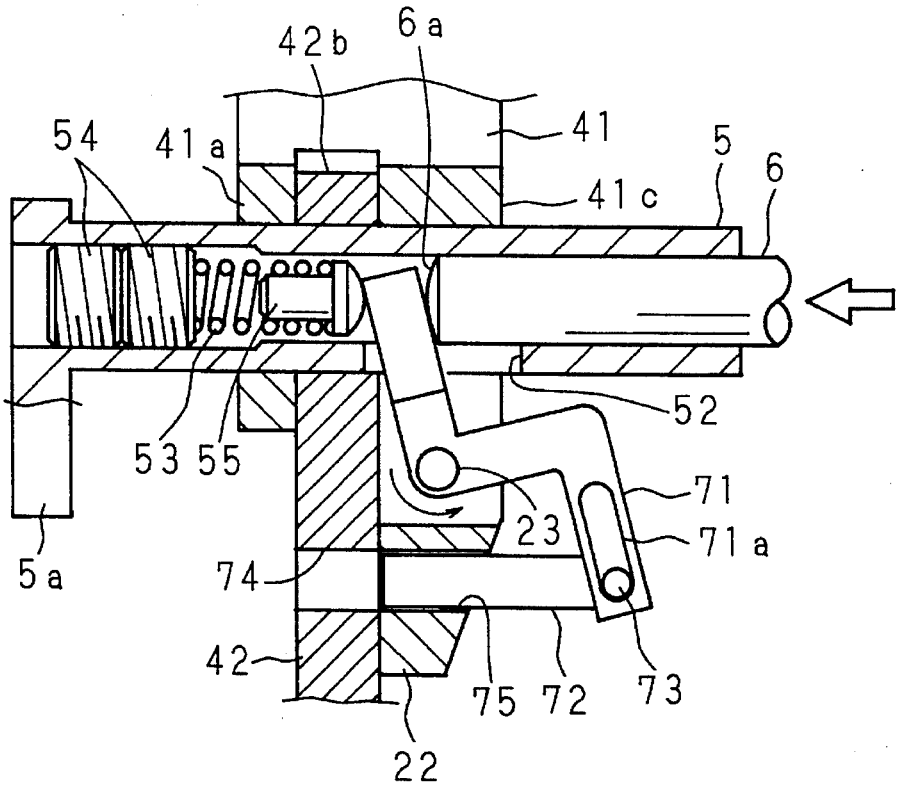
FIG. 7A is a perspective view showing the construction of a transmission system for a needle bar equipped with the needle bar stop device of a second embodiment.
Figure 7B:
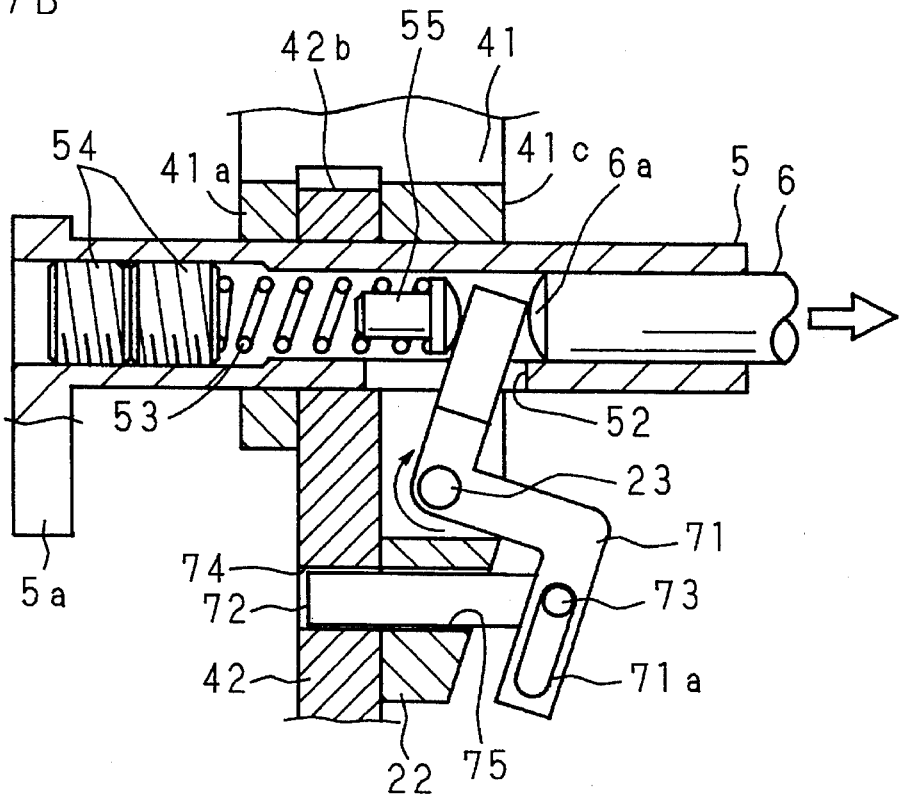
FIG. 7B is a perspective view showing the construction of a transmission system for a needle bar equipped with the needle bar stop device of a second embodiment.

Although in the embodiment 1, the engagement and retreat to the engaging hole 20 is realized by swing of the engaging member 2 within the insertion hole 22 in the shape of the slot, in the following construction the same efficacy is obtained. As shown in FIG. 7, a circular engaging hole 74 and an insertion hole 75 are formed to be able to align with each other. An engaging member 72 of a pin shape is fitted in the insertion hole 75 and the end of the engaging member 72 is supported by a swinging member 71 having a long hole 71*a* via a pivot pin 73. By insertion of the operation rod 6, the swinging member 71 swings counterclockwise and the engaging member 72 is not inserted in tile engaging hole 74 (FIG. 7A). Otherwise by retreat of the operation rod 6, the swinging member 71 swings clockwise and the engaging member 72 is engaged with the engaging hole 74 (FIG. 7B).

Embodiment 3

Figure 8:
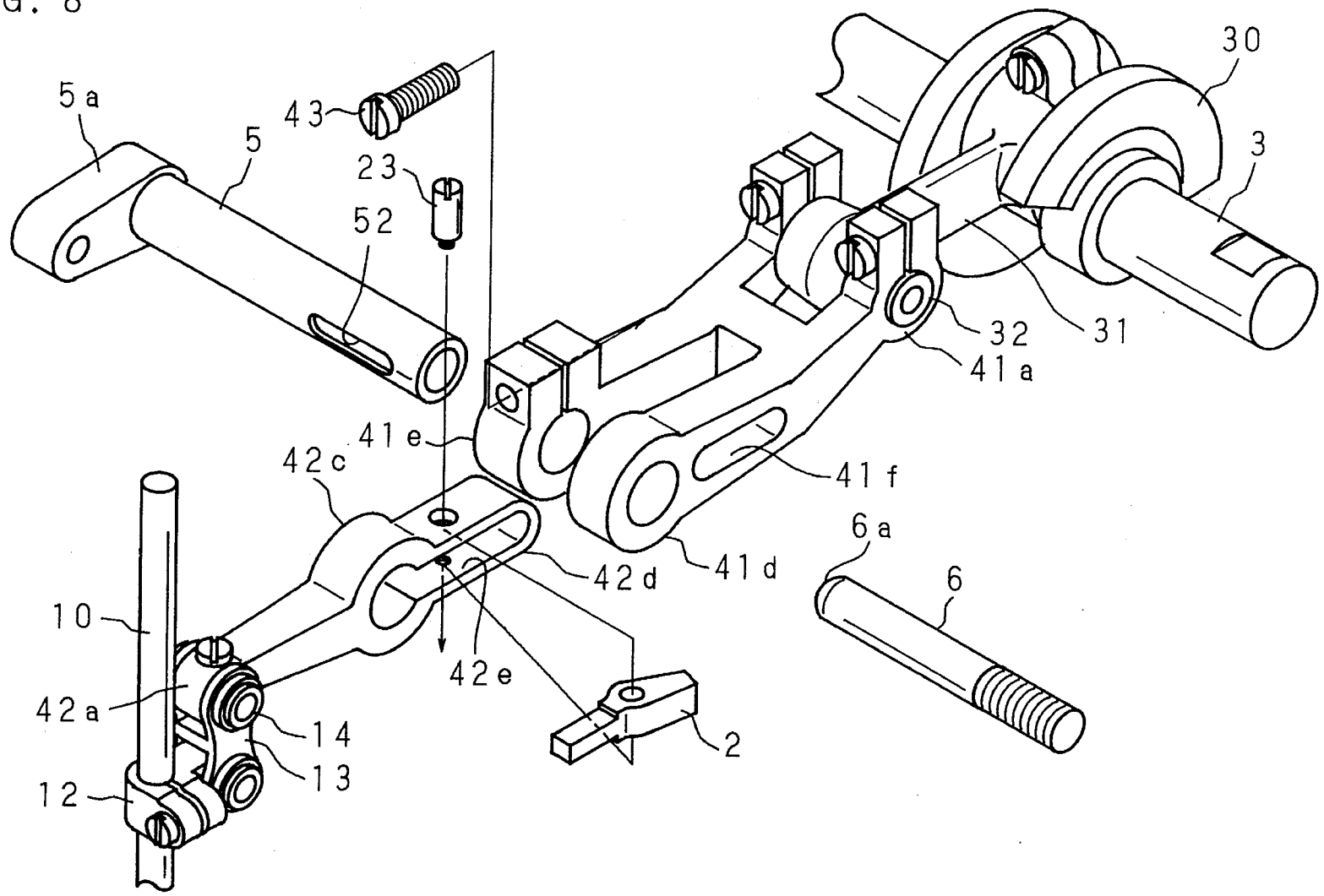
FIG. 8 is a perspective view showing the construction of a transmission system for a needle bar equipped with the needle bar stop device of a third embodiment.

In the first embodiment, the extended part 21 extending along the second arm 42 is provided at the first arm 41 on the main shaft 3 side. It is also possible to obtain the same efficiency in such a construction that the extended part 42*d* extending along the first arm 41 is provided at the second arm 42 on the needle bar side, contrariwise as shown in FIG. 8, and the engagement and retreat of tile engaging member 2 is performed between an insertion hole 42*e* formed in the extended part 42*d* and the engaging hole 41*f* formed in the first arm 41.

In the device of the present invention as above detailed, the needle bar arm swaying for transmission of the rotation from the main shaft to the needle bar is composed of two separate arms; the first arm on the main shaft side and the second arm in the needle bar side, one arm of which is provided with an extended part extending along the side surface of the other arm. The transmission From the first arm to the second arm is performed through the engaging member For engaging in the state of surface contact with the insertion hole formed in the extended part and the engaging hole formed in the other arm. Thereby, the device can alleviate occurrence of the unsatisfactory operations in due course by cutting off repeatedly the transmission to the needle bar and can cope with the tendency to seam at high speed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A needle bar stop device for a sewing machine, comprising:

a main shaft to be rotated by a drive source;

a sub-shaft parallel to said main shaft and being rotatable to drive a knife mechanism in response to the rotation of said main shaft;

a first arm for swaying transversely about said sub-shaft in response to the rotation of said main shaft, a second arm capable of swaying transversely about said sub-shaft;

a coupling mechanism for selectively coupling and decoupling said first arm to said second arm and for swaying said second arm when said first and second arms are coupled; and a needle bar connected to said second arm for movement up and down when the first and second arms are coupled by said coupling mechanism, the movement of said needle bar being stopped when said first and second arms are decoupled.

2. A needle bar stop device as set forth in claim 1 wherein said coupling mechanism comprises:

an extended part formed on the first arm extending along a surface on one side of said second arm;

an insertion hole in said first arm extended part;

an engaging hole in said second arm for alignment with said insertion hole;

a movable engaging member in said first arm insertion hole; and an operation means for controlling movement of said engaging member to move into and retreat from said second arm engaging hole to couple said first arm to and decouple it from said second arm.

3. A needle bar stop device as set forth in claim 2, wherein said engaging member is of rectangular shape and said insertion and engaging holes are elongated in the longitudinal direction of said extended part.

4. A needle bar stop device as set forth in claim 2, wherein said engaging member is in the shape of a pin and said insertion and engaging holes are round.

5. A needle bar stop device as set forth in claim 1, wherein said coupling mechanism comprises:

an extended part formed on the second arm extending along a side surface of said first arm;

an insertion hole in said second arm extended part;

an engaging hole in said first arm for alignment with said insertion hole;

a movable engaging member fitting in said first arm insertion hole; and an operation means for controlling movement of said engaging member to move into and retreat from said first arm engaging hole to couple said first arm to and decouple it from said second arm.

6. A needle bar stop device as set forth in claim 5, wherein said engaging member is of rectangular shape and said insertion and engaging holes are elongated in the longitudinal direction of said extended part.

7. A needle bar stop device as set forth in claim 5, wherein said engaging member is in the shape of a pin and said insertion and engaging holes are round.

* * * * *